US007904973B2

(12) United States Patent
Lian

(10) Patent No.: US 7,904,973 B2
(45) Date of Patent: Mar. 15, 2011

(54) WATER OUTLET ASSEMBLY OF STOOL WASHING DEVICE

(75) Inventor: Yu-Chang Lian, Tai-Chung (TW)

(73) Assignee: Song Yang Ltd., Co, Taichung (TW)

( * ) Notice: Subject to any disclaimer, the term of this patent is extended or adjusted under 35 U.S.C. 154(b) by 876 days.

(21) Appl. No.: 11/841,002

(22) Filed: Aug. 20, 2007

(65) Prior Publication Data

US 2009/0050223 A1 Feb. 26, 2009

(51) Int. Cl.
*A47K 4/00* (2006.01)

(52) U.S. Cl. ..... 4/420.4

(58) Field of Classification Search ..... 4/420.2, 4/420.4, 420.5, 433, 444, 447, 448, 443
See application file for complete search history.

(56) References Cited

U.S. PATENT DOCUMENTS 4,068,325 A * 1/1978 Benthin ..... 4/420.4
5,101,520 A * 4/1992 Lockhart ..... 4/447
5,647,069 A * 7/1997 Han et al. ..... 4/420.2

* cited by examiner

*Primary Examiner* — Huyen Le

(57) ABSTRACT

A water outlet assembly of a stool washing device comprises a water outlet head installed with a main portion and a sub-portion; an upper end of the water outlet head having a main inlet and a sub-inlet; the main inlet being communicated to the output hole of the main portion and the sub-inlet being communicated to the outlets of the sub-portion; an adjust portion having two insertion ends at a lower end thereof; each insertion end having a ball like shape; a lower end of each insertion end having a through hole; the insertion ends being engaged to the main inlet and the sub-inlet with the through holes being communicated to the main inlet and the sub-inlet; wherein rotation of the adjust portion will adjust the water output from the outlets.

5 Claims, 7 Drawing Sheets

WATER OUTLET ASSEMBLY OF STOOL WASHING DEVICE

FIELD OF THE INVENTION

The present invention relates to stool flushing device, and particularly to a water outlet assembly of a stool washing device which has two water outlet portions, and has the functions of angle and transversal adjustments. The water outlet is adjustable to a desired one.

BACKGROUND OF THE INVENTION

In the prior art stool, only one water outlet is installed for flushing water, however, this kind deign can not flush the stool effectively and completely. Thus in another design, the stool has two outlets with two water tubes, but the two tubes are adjusted individually. Thus the operation is tedious.

Furthermore in the prior art, the spraying head is fixed to the stool by screwing or riveting a retaining sheet. The assembly work is difficult and time consumed. In another prior art, the water outlet head is buckled to the stool by using a stool, but in that, the position of the head cannot be adjusted transversally. Thereby all these make difficult in operation and assembly.

Therefore, there is an eager demand for a novel one which can improve the defect in the prior art.

SUMMARY OF THE INVENTION

Accordingly, the primary object of the present invention is to provide a water outlet assembly of a stool washing device which has two water outlet portions, and has the functions of angle and transversal adjustments. The water outlet is adjustable to a desired one.

To achieve above objects, the present invention provides a water outlet assembly of a stool washing device which comprises a water outlet head installed with a main portion and a sub-portion; an upper end of the water outlet head having a main inlet and a sub-inlet; the main inlet being communicated to the output hole of the main portion and the sub-inlet being communicated to the outlets of the sub-portion; an adjust portion having two insertion ends at a lower end thereof; each insertion end having a ball like shape; a lower end of each insertion end having a through hole; the insertion ends being engaged to the main inlet and the sub-inlet with the through holes being communicated to the main inlet and the sub-inlet; wherein rotation of the adjust portion will adjust the water output from the outlets.

The various objects and advantages of the present invention will be more readily understood from the following detailed description when read in conjunction with the appended drawing.

BRIEF DESCRIPTION OF THE DRAWINGS

FIG. 1-1 is a structural cross sectional perspective view of the water outlet assembly of a stool washing device of the present invention.

DETAILED DESCRIPTION OF THE INVENTION

Figure 1:
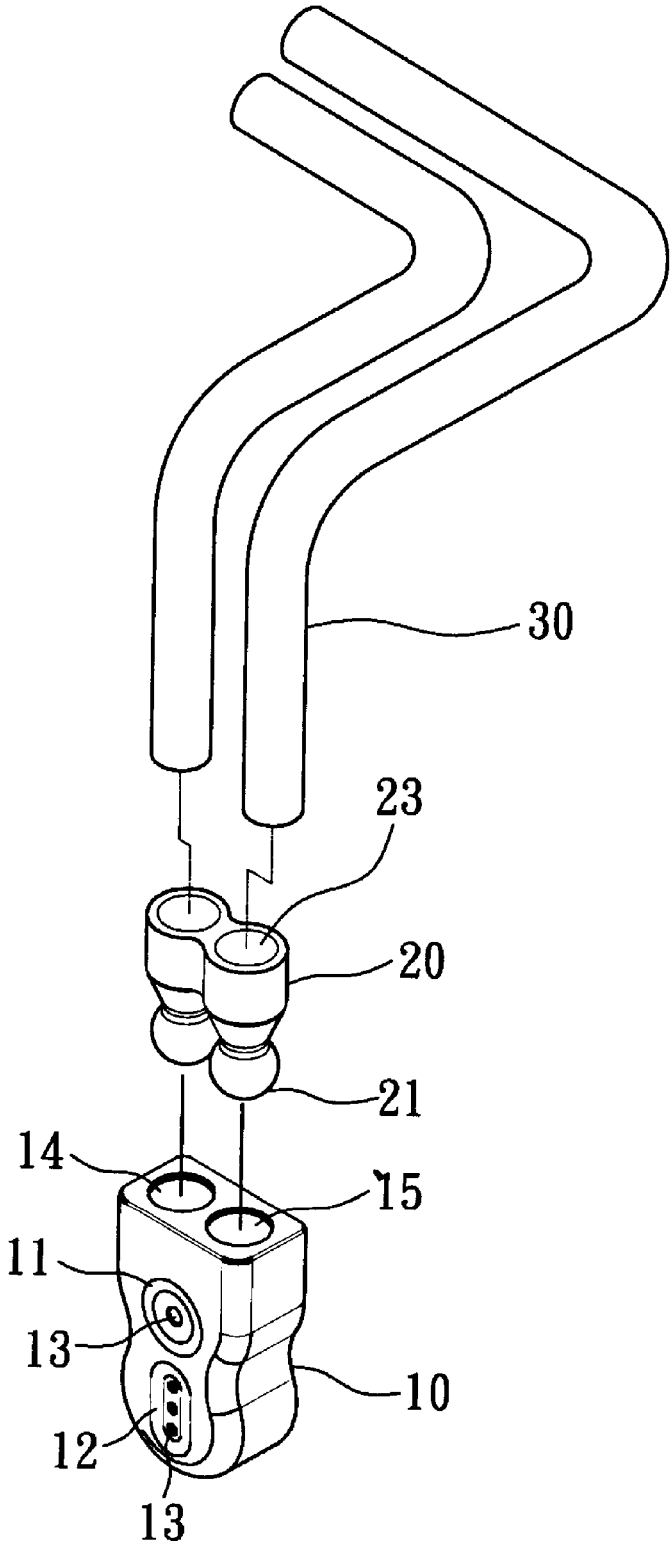
FIG. 1 is a partial exploded view of the water outlet assembly of a stool washing device of the present invention.
Figure 1:
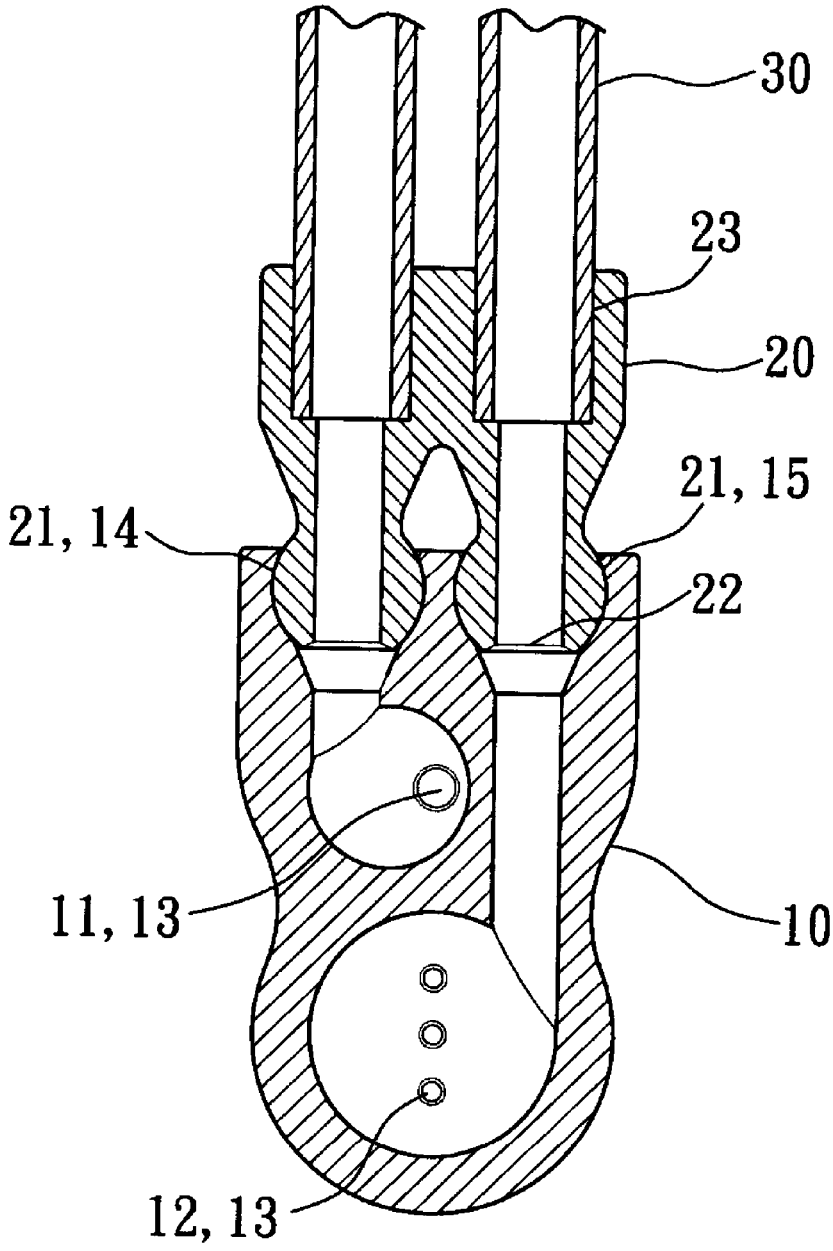
Figure 2:
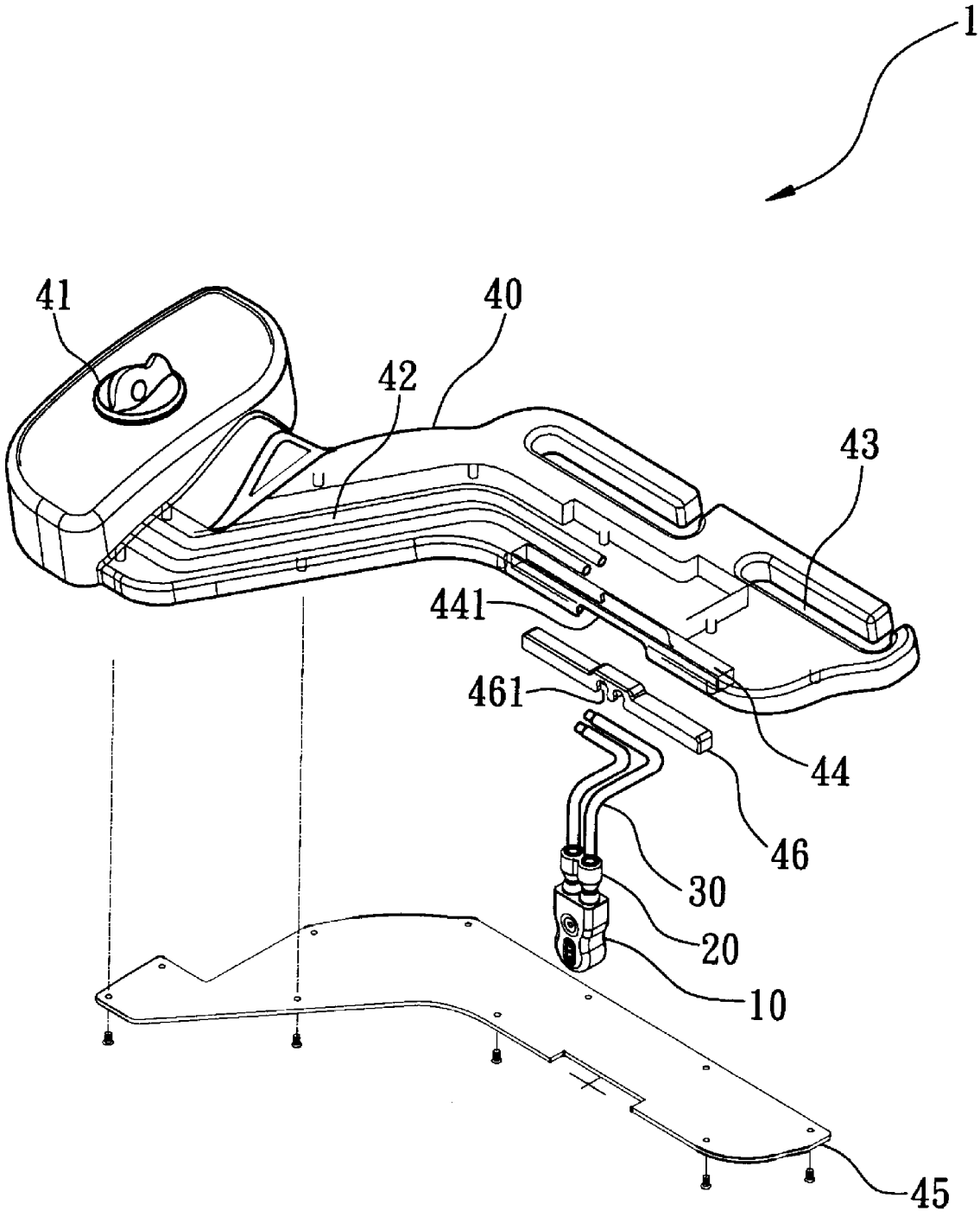
FIG. 2 is an exploded perspective view of the water outlet assembly of a stool washing device of the present invention.
Figure 3:
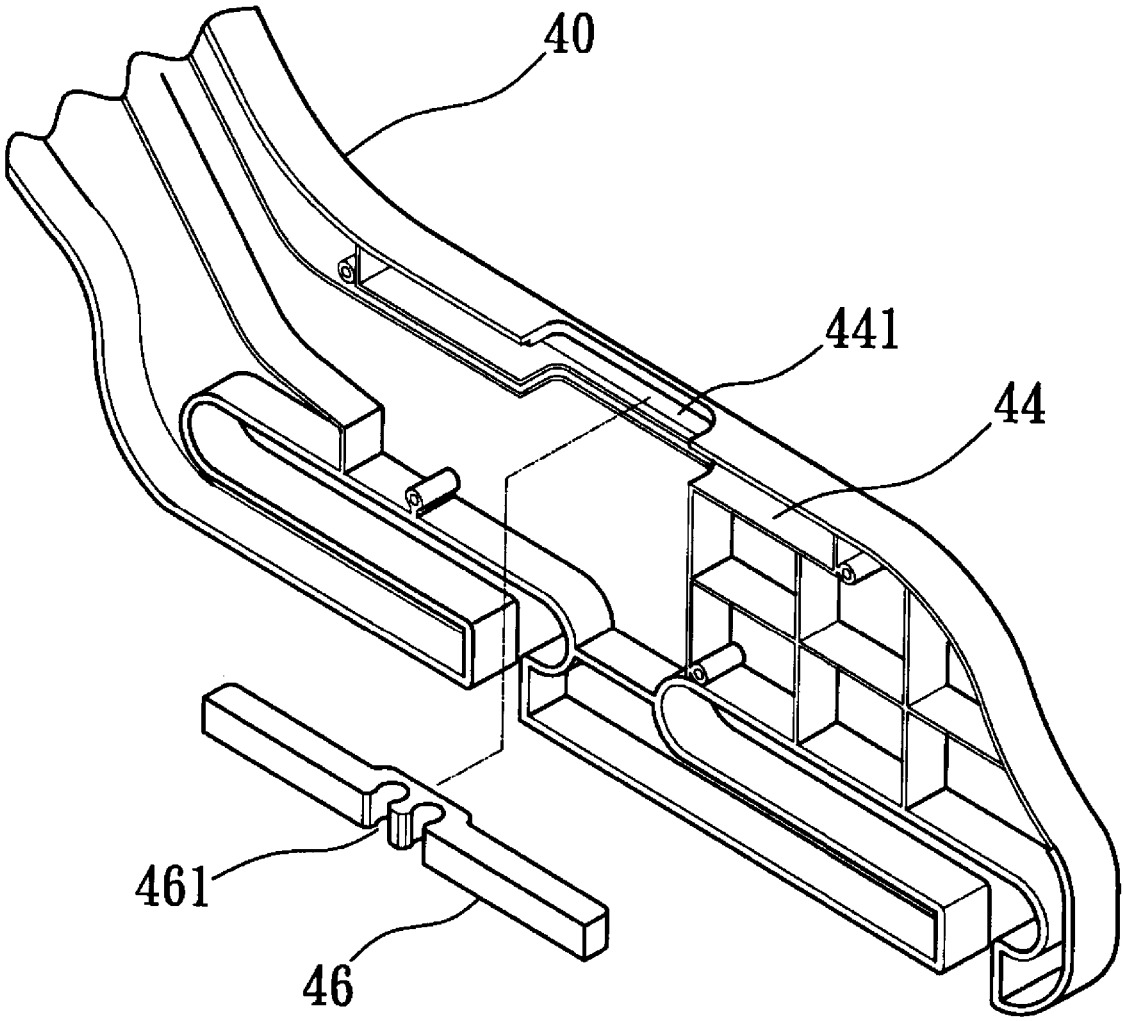
FIG. 3 is a schematic view of the water outlet assembly of a stool washing device of the present invention, where it is viewed from another angle.
Figure 4:
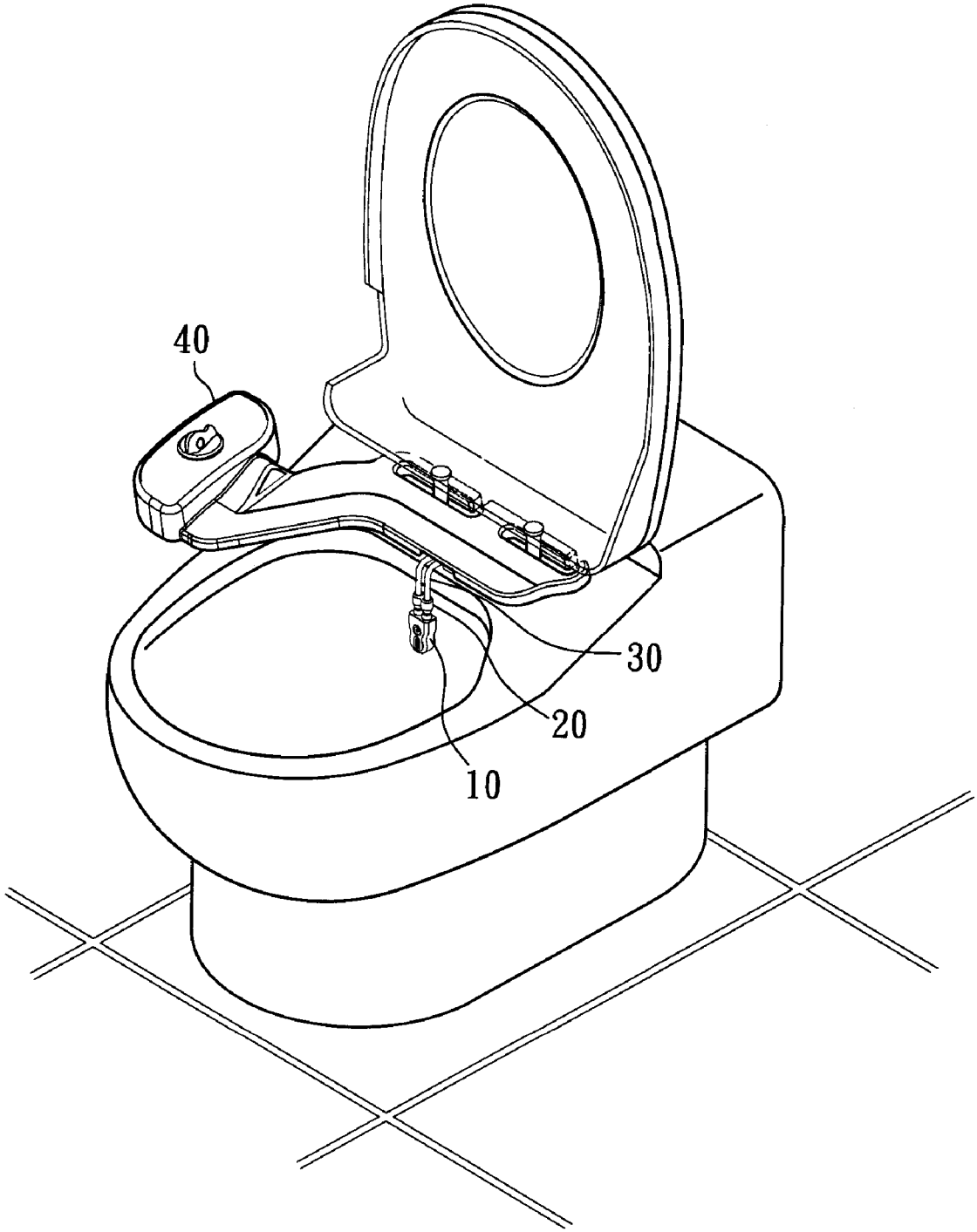
FIG. 4 is a schematic view showing the water outlet assembly of a stool washing device of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 4, the water outlet assembly of a stool washing device of the present invention is illustrated. The structure of the present invention will be described hereinafter.

A water outlet head 10 is a flat block. A flat surface of the water outlet head 10 is installed with a main portion 11 and a sub-portion 12. In this embodiment, the main portion 11 has an outlet 13 for outputting water and the sub-portion 12 has three outlets 13 for outputting water. However, the numbers of the outlets 13 in the main portion 11 and sub-portion 12 are not confined to this example.

An upper end of the water outlet head 10 has a main inlet 14 and a sub-inlet 15. The main inlet 14 is communicated to the output hole 21 of the main portion 11 and the sub-inlet 15 is communicated to the outlets 13 of the sub-portion 12.

An adjust portion 20 has two insertion ends 21 at a lower end thereof. Each insertion end 21 has a ball like shape (see FIG. 1-1). A lower end of each insertion end 21 has a through hole 22. The insertion ends 21 are engaged to the main inlet 14 and the sub-inlet 15 with the through holes 22 are communicated to the main inlet 14 and the sub-inlet 15. Rotation of the adjust portion 20 will adjust the water output from the outlets 13.

The adjust portion 20 has two connection ends 23 at an upper end thereof. The two connection ends 23 are communicated to the two insertion ends 21.

Two water tubes 30 are connected to the two insertion ends 21 of the adjust portion 20. Water flows from the two water tubes 30 to the two connection ends 23, the two insertion ends 21, the main inlet 14 and sub-inlet 15 and then to the outlet 13 of the main portion 11 and the outlets 13 of the sub-portion 12.

The positioning disk 40 is a cover like structure. The positioning disk 40 is installed with a control switch 41. A pipe set 42 with two pipe lines is installed in the positioning disk 40. The control switch 41 serves to open and close the water flow of the water tube 30. The pipe set 42 has an elastic structure. One end of the positioning disk 40 is a combining portion 43 which can be installed to a stool. The positioning disk 40 has a long and slender sliding groove 44 at an end opposite to the combining portion 43. Two ends of the sliding groove 44 are installed with respective openings 441.

A bottom end of the positioning disk 40 is installed with a cover plate 45 having a shape corresponding to that of the positioning disk 40 so as to seal the positioning disk 40 and thus to confine the elements in the positioning disk 40.

An adjusting block 46 is installed in the sliding groove 44 of the positioning disk 40. A length of the sliding groove 44 is slightly shorter than that of the sliding groove 44 so as to be received in the sliding groove 44 and is able to slide in the sliding groove 44. The adjusting block 46 is formed with an embedding groove 461 at a position corresponding to the openings 441. The pipe set 42 of the positioning disk 40 can be installed to the embedding groove 461 so that the water outlet head 10 is interacted with the adjusting block 46.

Figure 6:
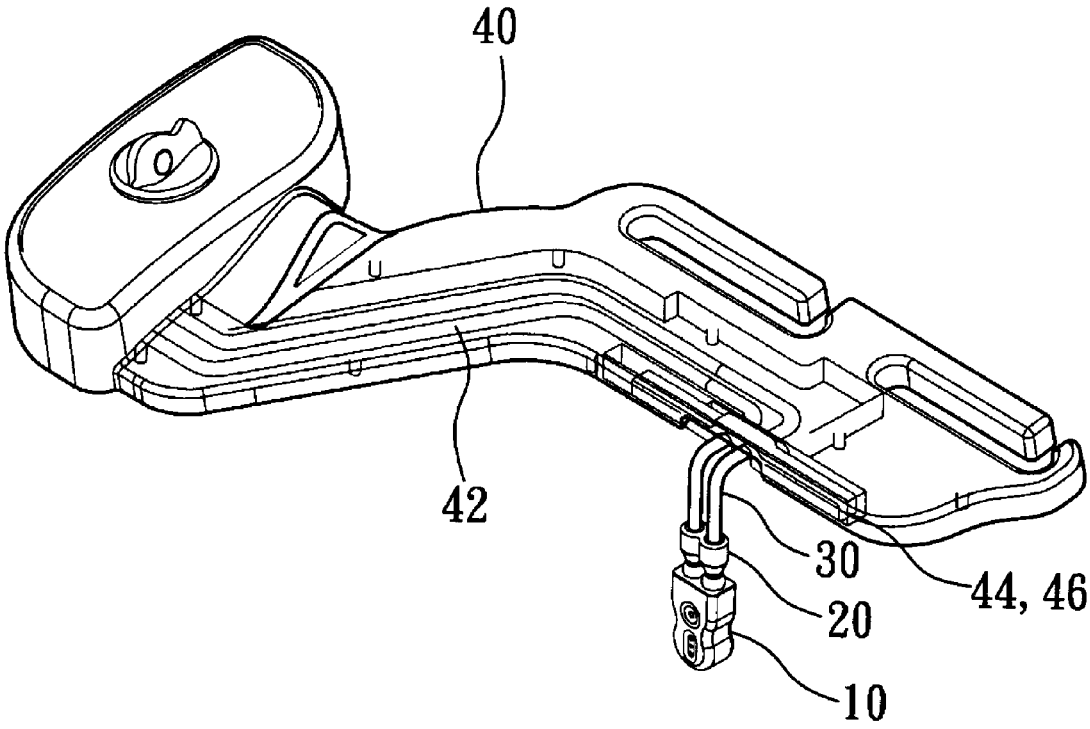
FIGS. 5 and 6 are schematic views showing the linear adjusting operation of the present invention.
Figure 5:
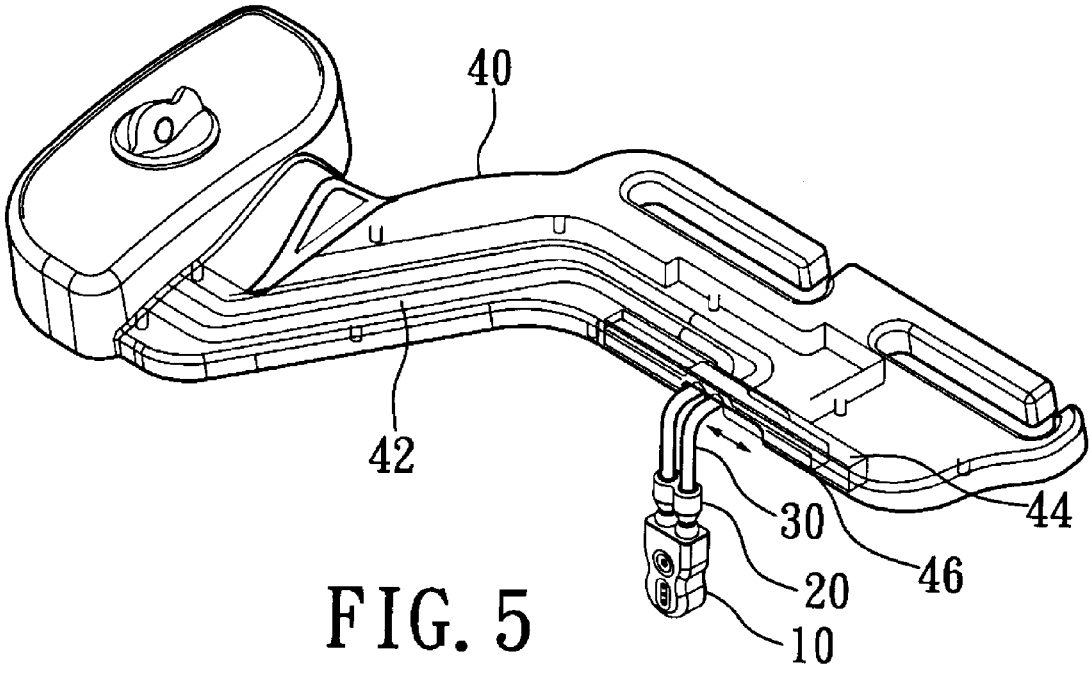

In the present invention, the adjustment of the water outlet head 10 is not necessary to detach it as reference to FIGS. 5 and 6.

In FIG. 5, when the water outlet head 10 is moved to left, the water tubes 30 will drive the adjusting block 46 to move along the sliding groove 44 leftwards. The pipe set 42 is flexible and thus it is deform to match the adjustment of the water tube 30.

On the contrary, if the water outlet head 10 is moved rightwards, it will move to a position for flushing water.

Figure 7:
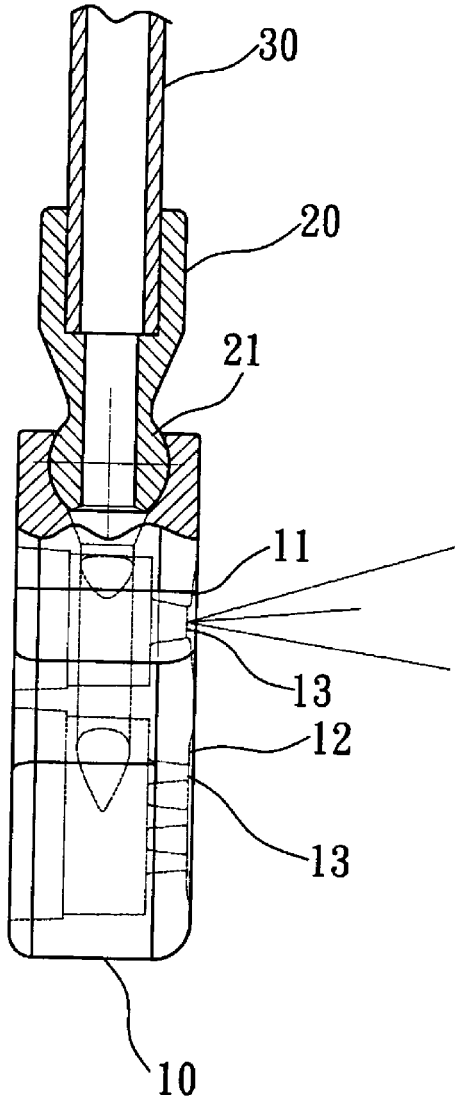
FIGS. 7 and 8 are schematic views showing the angle adjustment of the water outlet head of the present invention.
Figure 8:
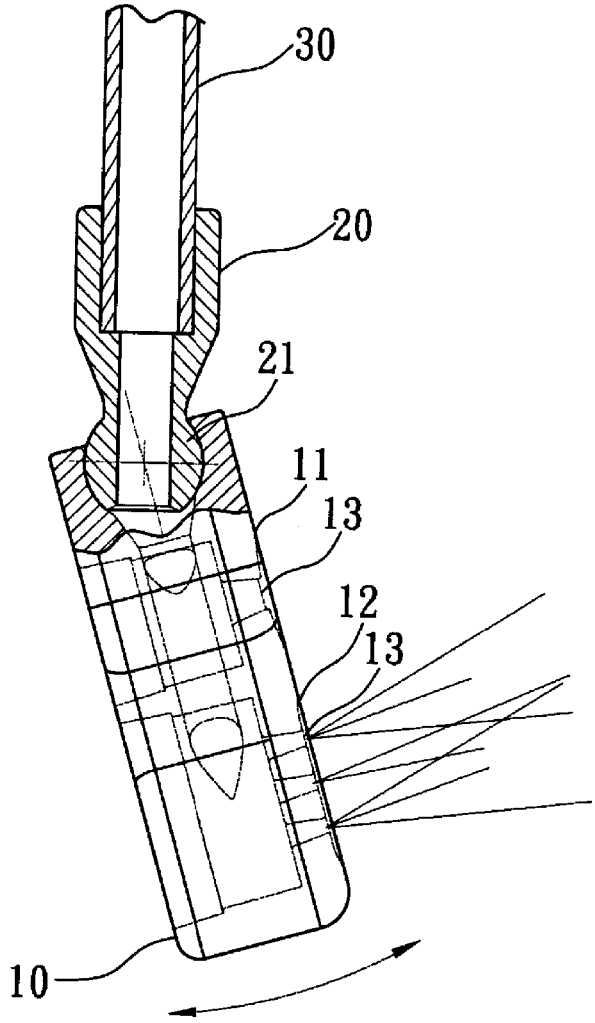

Referring to FIGS. 7 and 8, the angle adjustment of the water outlet head 10 of the present invention is illustrated. When the water outlet head 10 is at a predetermined position in the stool, it has the effect of flushing water. The ball shape insertion ends 21 have the effect of adjusting the angle of the water outlet head 10. The main portion 11 and sub-inlet 15 make the user can have different flushing effect as desired.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A water outlet assembly of a stool washing device, comprising:

a water outlet head installed with a main portion and a sub-portion;

an upper end of the water outlet head having a main inlet and a sub-inlet; the main portion having at least one outlet defined therein and the sub-portion having at least one outlet defined therein, the main inlet being communicated to the at least one outlet of the main portion and the sub-inlet being communicated to the at least one outlets of the sub-portion; and an adjust portion movably connected to the water outlet head, the adjust portion having two insertion ends formed on a lower end thereof; each insertion end having a ball like shape; a lower end of each insertion end having a through hole defined therein; the two insertion ends respectively engaged with the main inlet and the sub-inlet, the through holes respectively communicated to the main inlet and the sub-inlet, such that the water outlet head is adjustably moved relative to the adjust portion;

whereby, the water outlet assembly can provide different flushing effect by using the main portion and the sub-inlet.

2. The water outlet assembly of a stool washing device as claimed in claim 1, wherein the adjust portion has two connection ends at an upper end thereof; the two connection ends respectively communicated to the two insertion ends and respectively connected with two water tubes.

3. The water outlet assembly of a stool washing device as claimed in claim 2, further comprising:

a positioning disk being installed with to a control switch; a pipe set with two pipe lines being installed in the positioning disk; the control switch serving to open and close the water flow of the water tubes; the pipe set has having an elastic structure; a combining portion formed on one end of the positioning disk and installed to a stool; the positioning disk having a long and slender sliding groove defined in an end thereof opposite to the combining portion; and two ends of the sliding groove are installed with respective openings; an adjusting block being installed in the sliding groove of the positioning disk; a length of the sliding groove being slightly shorter than that of the sliding groove so as to be slidably received in the sliding groove.

4. The water outlet assembly of a stool washing device as claimed in claim 3, wherein a bottom end of the positioning disk is installed with a cover plate.

5. The water outlet assembly of a stool washing device as claimed in claim 3, wherein the adjusting block is formed with an embedding groove at a position corresponding to the openings; the water outlet head is connected to two water tubes which are embedded to the embedding groove of the adjusting block.

* * * * *